United States Patent [19]

Zander et al.

[11] Patent Number: 4,917,309

[45] Date of Patent: Apr. 17, 1990

[54] PROCESS FOR MICRONIZING SOLID MATTER IN JET MILLS

[75] Inventors: Hans-Günter Zander; Horst Bornefeld; Bernd-Michael Holle, all of Krefeld, Fed. Rep. of Germany

[73] Assignee: Bayer Aktiengesellschaft, Leverkusen, Fed. Rep. of Germany

[21] Appl. No.: 330,554

[22] Filed: Mar. 30, 1989

Related U.S. Application Data

[63] Continuation of Ser. No. 144,350, Jan. 15, 1988, Pat. No. 4,880,169.

[30] Foreign Application Priority Data

Jan. 30, 1987 [DE] Fed. Rep. of Germany ..... 3702787

[51] Int. Cl.[4] ..... B02C 19/06

[52] U.S. Cl. ..... 241/5; 241/16

[58] Field of Search ..... 241/5, 39, 40, 33, 34, 241/152 R, 29, 16, 22

[56] References Cited

U.S. PATENT DOCUMENTS

| | | | |
|---|---|---|---|
| 2,515,541 | 7/1950 | Yellott | 241/39 |
| 2,628,786 | 2/1953 | Paperoux et al. | 241/39 |
| 2,636,688 | 4/1953 | Singh | 241/39 X |
| 3,815,833 | 6/1974 | Vliet et al. | 241/39 X |
| 4,502,641 | 3/1985 | Coombe | 241/39 X |
| 4,504,017 | 3/1985 | Andrews | 241/152 R X |

FOREIGN PATENT DOCUMENTS

| | | |
|---|---|---|
| 2623880 | 5/1976 | Fed. Rep. of Germany . |
| 343978 | 6/1978 | Fed. Rep. of Germany . |

OTHER PUBLICATIONS

CF Winnacker Kuchler: Chemische Technologie, 4 Edition, vol. 1, pp. 91-93, Carl Hanser Verlag Munchen, Wien 1984.

*Primary Examiner*—Mark Rosenbaum

*Attorney, Agent, or Firm*—Sprung Horn Kramer & Woods

[57] ABSTRACT

A process for micronizing solid matters in a jet mill, wherein the solid matters are brought into the jet mill across an injector and wherein the micronization takes place, if necessary, in the presence of milling aids and/or dispersing agents, wherein the solid matters are forcibly supplied to the injector and an apparatus for carrying out the process, the apparatus comprising a dosing means, a forcible entry means, and injector and a jet mill.

5 Claims, 1 Drawing Sheet

PROCESS FOR MICRONIZING SOLID MATTER IN JET MILLS

This is a continuation of application Serial No. 07/144,350, filed Jan. 15, 1988, now U.S. Pat. No. 488016.

BACKGROUND OF THE INVENTION

1. Field of the Invention

The invention relates to a process for micronizing solid matter in jet mills, wherein the solid matter is brought into the jet mill across an injector by means of a propellant and wherein the micronizing takes place if necessary in the presence of grinding and/or dispersing agents.

2. Background of Information

The micronizing of solid matter can be carried out in jet mills, for example, of the type of the spiral or counter-pipe jet mills (CF Winnacker, Küchler: Chemische Technologie, 4 Edition, Volume 1, P.91–93, Carl Hanser Verlag München, Wien 1984). Jet mills consist of a milling section, into which water vapor jets or air jets are blown at high speeds, and the solid matter to be micronized (in the following also termed "milling goods") is brought in across an injector by a propellant. Compressed air or water vapor (in the following referred to in short as "steam"), is usually used as the propellant in this process. The introduction of the solid matter into the injector occurs as a rule across a feeding hopper or an entry chute.

Milling aids are also often added to the solid matter in order to support the micronization. Further, dispersing agents are usually used especially with pigments, improving their dispersability in various material and simultaneously supporting the micronizing of the pigment. The manner mentioned above of introducing solid matter into jet mills has the disadvantage that milling disturbances can occur as a result of blockages of the injector and sedimenting of the milling goods on the walls of the feeding hopper.

These milling disturbances lead as a rule to a decreased quality of the micronized solid matter. In addition, milling goods can leave the jet mill, which is at high pressure, during these milling disturbances.

SUMMARY OF THE INVENTION

An object of the invention was to prepare a process for the micronizing of solid matter in jet mills that does not display the disadvantages described.

It was then found that milling disturbances and the problems associated with them do not occur if the solid matter is forcibly introduced into the injector of the jet mills.

By the expression "forcible introduction of the solid matter" it is understood according to the invention that only one degree of freedom of movement is available to the solid matter, i.e., that the solid matter is transported in a forced direction of movement. A deviation of the solid matter into a different direction of movement, as was possible in the usual introduction of solid matter into the injector across feeding hoppers or entry chutes (the exiting of milling goods from the jet mill due to blockages in the apparatus), is excluded.

An object of the invention is thus a process for micronizing solid matter in jet mills, wherein the solid matter is introduced into the jet mill across an injector wherein the micronizing occurs if necessary in the presence of milling aids and/or dispersing agents, characterized in that the solid matter is forcibly introduced into the injector.

DETAILED DESCRIPTION OF THE INVENTION

Figure 1:
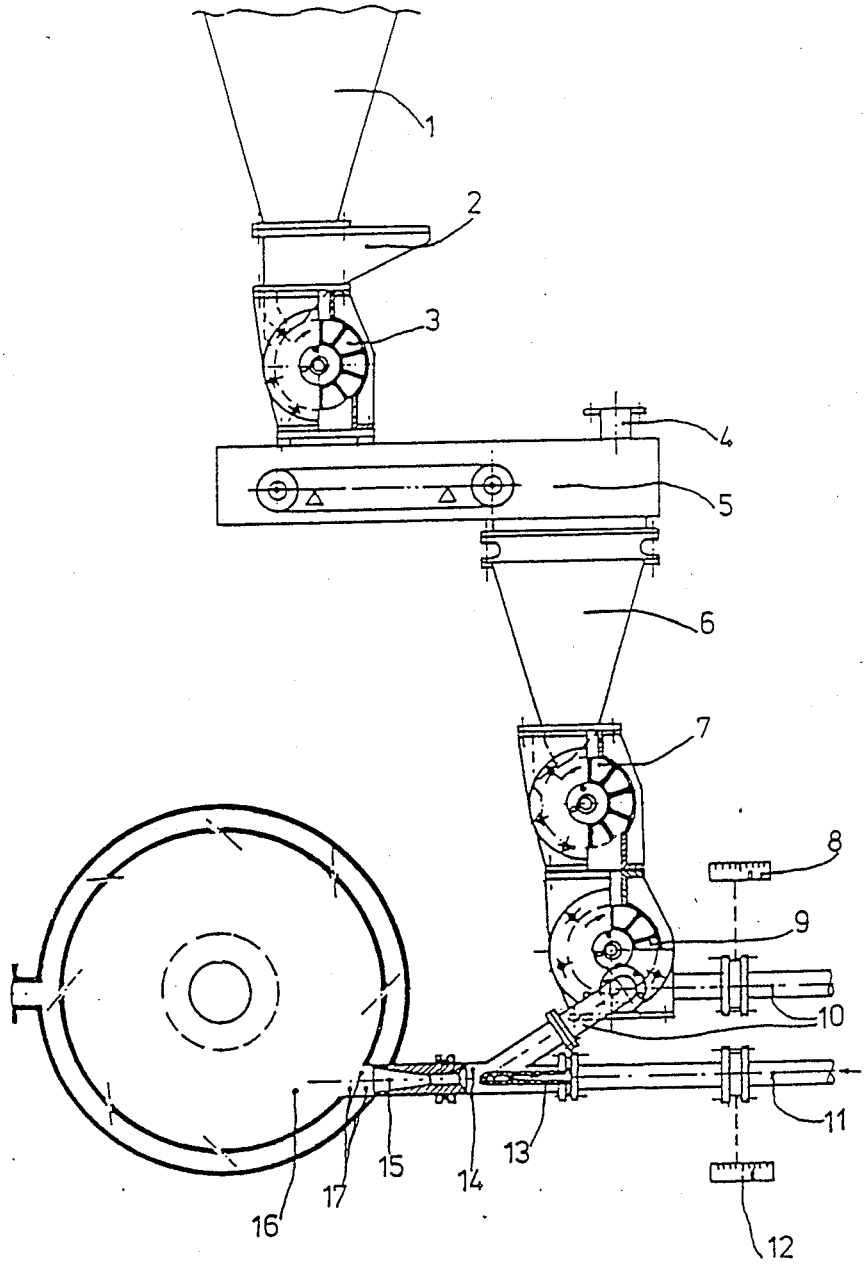
FIG. 1 is a partial cross-sectional view of a device according to the present invention.

The forcible introduction of solid matter occurs preferably across a pneumatic delivery device. The solid matter is fluidized with a propellant, preferably compressed air, in this pneumatic delivery device, and transported to the injector. The fluidizing of the solid matter can also occur with other gases, as for example steam.

In order to guarantee a disturbance-free operation of the pneumatic delivery device, it is advantageous to introduce the solid matter forcibly and free of recoil into the latter. This takes place preferably by means of a manlock. In the process, suitable manlocks of the most various construction types can be used. Manlocks consisting of a combination of a delivery sluice and a blow-through sluice are preferred.

It is particularly advantageous if the introduction of the solid matter into the pneumatic delivery device occurs in even doses.

The even dosing is preferably undertaken through dosing scales. It can, however, also be achieved by a volume measurement of the solid matter. These process variants enable the maintenance of defined propellant-/solid matter relations in the pneumatic delivery device. Depending on the requirements, the propellant/solid matter relation can thereby be adapted to the desired value at all times by varying the quantity of solid matter.

In the process according to the invention, injectors are preferred which consist according to FIG. 1 of a combination of a steam line (11), a jet nozzle (13), a solid matter/steam/air mixing pipe (14) and a collecting nozzle (15). This special arrangement guarantees an even introduction of the solid matter/carrier gas mixture into the jet mill placed under high pressure.

In a very advantageous variant of the process according to the invention, the forcible introduction of the solid matter and, if necessary, the addition of milling aids and/or dispersing agents is monitored across a pressure measurement at an appliance in the jet mill, wherein the appliance serves, if necessary, as a milling aid and/or dispersing agent distributing device at the same time.

The pressure measurement occurs preferably in measuring cycles, wherein blocking of the device between the measuring cycles is avoided by means of a pressure impulse or by means of a constant quantity of rinsing air on which a pressure impulse is superimposed between the measuring cycles.

The process according to the invention can be used in the micronizing of various solid matters. Pigments, especially inorganic pigments, such as titanium dioxide pigments, ionoxide pigments, chromiumoxide pigments and mixed phased pigments, can be micronized according to this process with particular advantage. By means of the special milling or dispersing agent distributing device in the jet mill, an even and homogeneous layering of the pigments with products is achieved.

No milling disturbances, with the problems associated with them, occur in carrying out the process according to the invention.

In addition, the milling process and the delivery of the solid matters is optimized through the described dosing and surveyance measures. This makes possible a significantly higher loading of the jet mill, without reducing the quality of the micronized solid matters.

An object of the invention is further a device for carrying out the process according to the invention. This device consists of (a) a dosing device,
(b) a forcible entry device,
(c) an injector, and
(d) a jet mill.

The dosing device can consist of the various appliances that enable a dosing of solid matters. It is advantageous that it should consist according to FIG. 1 of a combination of a supply container (1), a swinging slide (2), a star feeder (3) and a dosing scale (5).

The forcible entry device, the injector and the jet mill can also be a various kinds of construction.

In the process, the forcible entry device preferably consists according to FIG. 1 of a combination of an entry chute (6), a delivery sluice (7), a blow-through sluice (9) and a pneumatic delivery device (10).

Individual parts of the forcible entry device can be replaced by other suitable parts or apparatus. For example, instead of the delivery sluice (7) and the blow-through sluice (9), pressure sluices different in kind, but on an identical manner of functioning can be installed.

A device according to the invention is particularly preferred in which the injector consists according to FIG. 1 of a combination of a steam line (11), a jet nozzle (13), a solid matter/steam/air mixing pipe (14) and a collecting nozzle (15).

The injector can, however, also be of customary design. Such an injector is depicted, for example, in Winnacker, Küchler, Chemische Technologie, 4the Edition, Vol 1, page 93, Carl Hanser Verlag München, Wien 1984.

A device according to the invention is also particularly preferred in which an appliance (17) for pressure measurement is installed in the jet mill according to FIG. 1, serving, if necessary, as a milling aid and/or dispersing agent distributing device.

The process according to the invention and the appliance associated with it will now be more closely explained with reference to FIG. 1.

The milling goods enter into the supply vessel (1). A swing slide (2), with which the outlet can be closed and opened, is located at the outlet of the supply vessels. The milling goods arrive across the dosing scale (5), which is fed from the star feeder (3), at the forced entry device. The number of revolutions of the star feeder (3) is regulated independently of the desired quantity of the milling goods.

The junction main (4), to which a dust filter is attached, serves to equalize pressure. In the forcible entry appliance, the milling goods enter across the entry chute (6) into the pressure sluice, which consists of a delivery sluice (7) and a blow-through sluice (9). The solid matter is transported forcibly and without recoil across this special pressure sluice into the pneumatic delivery device (10). In the pneumatic delivery device, the milling goods are fluidized with compressed air and delivered to the solid matter/steam/air mixing pipe (14) of the injector. The quantity of compressed air can be surveyed with the measuring instrument (8), in the process. The fluidized milling goods are finally transported with steam, which is guided across the steam line (11) and the jet nozzle (13) to the solid matter/steam/air mixing pipe (14), across the collecting nozzle (15) into the jet mill (16). The quantity of steam is surveyed with the measuring instrument (12) in the process.

At the entry to the jet mill there is an appliance (17) for measuring pressure, across which milling and/or dispersing products can also be added. The appliance consists according to the invention of several openings or pipe ends, wherein an apparatus for measuring pressure is connected to one opening and one or several milling aids and/or dispersing agents can be added to the fluidized solid matter across the other openings. The addition of the milling aid and/or dispersing agent occurs therein preferably across dosing pumps.

The pressure measurement is carried out in measuring cycles. Between each measuring cycle, a pressure impulse or a constant quantity of rinsing air on which a pressure impulse is superimposed between the measuring cycles is applied to the appliance (17), by which means blocking of the appliance with solid matter is avoided.

With this special appliance, the whole milling process, including the dosing of the milling goods, the forcible entry of the solid matter into the injector, the driving of the injector and the addition of milling and/or other dispersing products can be surveyed. The addition of the milling aids and/or dispersing agents can take place in exact dependence on the weight of the milling goods with the help of the dosing scale and this special measuring device.

In case of deviations of the pressure within the mill from a predetermined desired value, i.e., deviations from the optimal milling conditions, quick corrective measures can be taken, whereby quality variations in the micronized solid matter can be safely avoided.

The following example shows the advantages of the process according to the invention compared with a customary process for the micronizing of solid matter:

EXAMPLE 1

A titanium dioxide pigment with rutile structure produced according to the sulphate process, that was subsequently treated with 0.8% by weight $SiO_2$ and 2.2% by weight $Al_2O_3$, was micronized in a device according to the invention according to FIG. 1 under addition of a dispersing product. A reaction product of trimethylol propane with ethylene oxide, dissolved in water was used as a dispersing product, as is described in DE-B-1,467,442, example 2. The quantity of dispersing product was 0.25% by weight in relation to the dry pigment.

The device was composed of the following individual parts:

(a) a dosing device, consisting of a combination of a supply silo (1), a swinging slide (2), a star feeder (3) and a belt weigher (5), wherein all instruments were of customary constructiontype;

(b) a forcible entry device, consisting of a combination of an entry chute (6) of customary construction type, a delivery sluice (7), a blow-through sluice (9) and a pneumatic transporting device (10), wherein the delivery sluice and the blow-through sluice were customary commercial star feeders of V4-steel with a star feeder diameter of 300 mm, and the pneumatic transporting device was a compressed air main with an orifice gauge;

(c) a special injector with a steam line (11) of customary construction type, a jet nozzle (13), a solid matter/-steam/air mixing pipe (14) and a collecting nozzle (15), wherein the jet mill was a customary commercial nozzle of cast bronze, the collecting nozzle consisted of a venturi tube of ST-60-steel and the solid matter/steam/air mixing pipe (14) was finished out of a V4A-steel pipe with a diameter of 80 mm;

(d) a spiral jet mill (16) of customary construction with a diameter of 915 mm, in which an appliance for pressure measurement (17) was located at the entrance of the mill behind the collecting nozzle (15), across which appliance the dispersing product distribution also took place.

The dispersing product was added in the quantity indicated to the fluidized pigment across a customary commercial dosing pump. The pressure measurement was achieved with a pressure measurement apparatus of customary construction type.

The pneumatic transporting device was driven with air at a pressure of 4 bar. 130 $cm^2$ (0.16 tons) of air were used per hour and per ton of the titanium dioxide pigment. 2.0 tons of steam per ton of the titanium dioxide pigment were required for the micronizing.

The flow rate of the titanium dioxide pigment was 2.0 to 2.3 tons per hour.

No milling disturbances of any kind occurred during the operation of this appliance, and the micronized titanium dioxide pigment could be maintained at the desired high quality.

EXAMPLE 2 (COMPARISON EXAMPLE)

The titanium dioxide pigment used in example 1 was micronized in a customary appliance under addition of the same dispersing product as the one depicted in Winnacker, Küchler, Chemische Technologie, 4th Edition, Vol. 1, page 93, Carl Hanser Verlag München, Wien, 1984. A spiral jet mill of the same type as in example 1 was used.

The entry of the pigment into the injector took place across an entry chute, wherein the injector and the entry chute were of customary construction type. The dispersing product addition was achieved by known means through the continuous spraying of the pigment in the entry chute in the same quantity as that given in example 1.

In the operation of this device, 2.4 tons of steam per ton of titanium dioxide pigment were used for the micronization. The flow rate of the titanium dioxide pigment was 1.5 to 1.8 tons per hour.

Up to ten milling disturbances appeared per day, which was also connected with the production of pigments of partially diminished quality.

A comparison with example 1 shows that in the application of the process according to the invention, the through-put quantities of the titanium dioxide pigment could be considerably increased. A steam saving of 0.4 tons per ton of the titanium dioxide pigment was connected to that, and the production of pigment of diminished quality is safely avoided.

It will be appreciated that the instant specification and claims are set forth by way of illustration and not limitation, and that various modifications and changes may be made without departing from the spirit and scope of the present invention.

What is claimed is:

1. A process for micronizing solid matters in a jet mill comprising introducing the solid matters in a jet mill across an injector, wherein the solid matters forcibly, pressure sluiced and pneumatically supplied so as to have only one degree of freedom of movement by a pneumatic delivery device to the injector.

2. A process according to claim 1, which further comprises the micronizing taking place in the presence of milling aids and/or dispersing agents.

3. A process according to claim 1, wherein the solid matters are brought into the pneumatic delivery device without recoil.

4. A process according to claim 1, wherein the introduction of the solid matters occurs in even dosages.

5. A process according to claim 1, wherein the injector comprises a steam line, a jet nozzle, a solid matter/-steam/air mixing pipe and a collecting nozzle.

* * * * *